US007997285B2

(12) United States Patent
Fischer et al.

(10) Patent No.: US 7,997,285 B2
(45) Date of Patent: Aug. 16, 2011

(54) EFFECT PACKAGING FOR A COSMETIC, IN PARTICULAR A MASCARA UNIT

(75) Inventors: Werner Fischer, Burk (DE); Friedrich Weigel, Wittelshofen (DE); Norbert Dumler, Ansbach (DE)

(73) Assignee: Geka Brush GmbH, Bechhofen (DE)

( * ) Notice: Subject to any disclaimer, the term of this patent is extended or adjusted under 35 U.S.C. 154(b) by 990 days.

(21) Appl. No.: 11/245,449

(22) Filed: Oct. 7, 2005

(65) Prior Publication Data

US 2006/0102192 A1 May 18, 2006

(30) Foreign Application Priority Data

Oct. 8, 2004 (EP) ..... 04023990

(51) Int. Cl.
*A45D 40/26* (2006.01)
*A46B 11/00* (2006.01)

(52) U.S. Cl. ..... 132/218; 132/320; 401/118

(58) Field of Classification Search ..... 132/218, 132/317, 320; 401/118, 126, 128–130; 220/23.89, 220/23.87

See application file for complete search history.

(56) References Cited

U.S. PATENT DOCUMENTS

| | | | | |
|---|---|---|---|---|
| 3,456,923 | A | 7/1969 | Zeuzem | |
| 4,921,366 | A * | 5/1990 | Hurrell | 401/126 |
| 5,054,946 | A | 10/1991 | Morel | |
| 5,549,200 | A * | 8/1996 | Cowan et al. | 206/362 |
| 6,309,124 | B1 | 10/2001 | Gueret | |
| 6,523,548 | B2 * | 2/2003 | Bouix et al. | 132/218 |
| 6,572,296 | B2 * | 6/2003 | Schrepf | 401/122 |
| 2003/0196672 | A1 * | 10/2003 | Kirita et al. | 132/218 |

FOREIGN PATENT DOCUMENTS

| | | | |
|---|---|---|---|
| DE | 7433846 | U1 | 4/1975 |
| DE | 4136821 | | 5/1992 |
| EP | 1262118 | A2 | 4/2002 |
| GB | 2388587 | A | 11/2003 |
| JP | 2000-202354 | A | 7/2002 |

OTHER PUBLICATIONS

DE 7433846 U1 Huck translation.*

Japanese Notice of Reason for Refusal dated Mar. 22, 2011 for JP Patent No. 2005-292374.

* cited by examiner

*Primary Examiner* — Rachel R Steitz

(74) *Attorney, Agent, or Firm* — Browdy and Neimark, PLLC

(57) ABSTRACT

In an effect packaging for a cosmetic, in particular a mascara unit, comprising a reservoir for the cosmetic and a lucent covering surrounding the reservoir, wherein the reservoir and covering are at least partially spaced from one another, it is provided that a centering device cooperating with the bottom of the reservoir is provided at the bottom of the outer covering, and that the reservoir and the outer covering are engageable with one another by the cooperation of a locking groove and a locking bead by an axial relative movement, for achieving an attractive appearance accompanied with a cost-effective producibility.

10 Claims, 2 Drawing Sheets

EFFECT PACKAGING FOR A COSMETIC, IN PARTICULAR A MASCARA UNIT

FIELD OF THE INVENTION

The invention relates to an effect packaging for a cosmetic, in particular a mascara unit, comprising a reservoir for the cosmetic and a lucent covering surrounding the reservoir, wherein the reservoir and covering are at least partially spaced from one another.

BACKGROUND OF THE INVENTION

Such packagings are particularly manufactured from plastics. The lucent outer covering in connection with the inner reservoir arouses the optical impression of a particularly thick-walled glass reservoir, which, corresponding to a possibly different distance between the inner reservoir and the outer covering, seems to have different wall thicknesses resulting in a high-quality optical impression.

Conventionally, the manufacture of such packagings is extensive and costly, e.g. a manufacture by injection molding, a so-called insert technique, where the reservoir is blown, inserted in a mold and co-molded, or the manufacture of a compound created by ultrasound welding.

SUMMARY OF THE INVENTION

Starting from this it is an object of the invention to create a packaging unit of the above mentioned kind which can be produced quickly and cost-effectively and which offers an attractive appearance when ready.

According to the invention, this object is attained in that a centering device interacting with the bottom of the reservoir is provided at the bottom of the outer covering, and in that the reservoir and the outer covering are engageable with one another by the cooperation of a locking groove and a locking bead by an axial relative movement. By the axial movement the centering device is also brought into engagement.

Advantageously, it is further provided that at least one axial groove and a protrusion engaging with the groove are provided on the reservoir and the covering, respectively, providing for a non-rotary connection.

The embodiment according to the invention enables the reservoir and the covering each to be manufactured separately and cost-effectively, and to be joined manually or mechanically by a simple axial movement. Due to the automatic centering an exactly defined distance between covering and reservoir is set and durably kept, so that the inner wall of the covering does not rest against the outer wall of the reservoir even where only a considerably small distance is provided, and thus the desired optical effect is not impaired.

Advantageously, it is provided that the centering device is formed by a spigot at the inner side of the bottom of the covering, which spigot engages with a corresponding recess at the bottom of the reservoir.

Favorably, the spigot is concave and has longitudinal slots for producing a more durable, defined connection.

For facilitating the engagement of the spigot with the recess, the top of the spigot can be conically or roundly tapered, respectively.

Preferably, the covering is formed in one piece and can be made of glass. The minimum air gap between covering and reservoir is preferably 0.1 mm. The wall thickness of the covering can be between 0.3 and 10 mm. The reservoir may be lucent or stained and may be printed, stamped or metallized. The covering may also be metallized at least partially. The filling volume of the reservoir can be between 1 and 30 ml.

The invention will become apparent from the ensuing description of an exemplary embodiment taking in conjunction with the drawing.

DESCRIPTION OF THE PREFERRED EMBODIMENT

Figure 1:
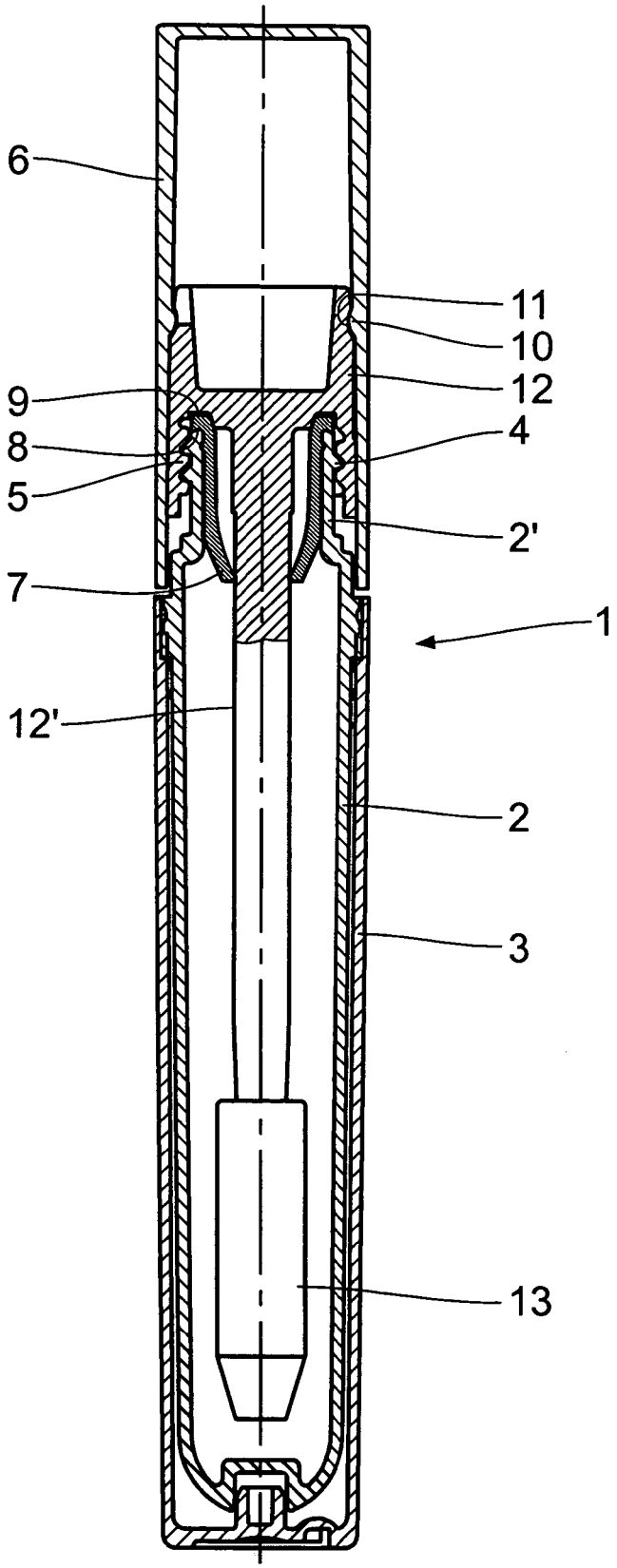
FIG. 1 is a longitudinal section of a complete cosmetic packaging according to the invention in the form of a mascara unit.

In the present embodiment, the cosmetic packaging according to the invention is explained on the basis of a mascara unit 1. However, the concept according to the invention may similarly be used for e.g. lip or nail cosmetics or other products depending on a high-quality impression of the packaging.

The mascara unit 1 comprises an inner reservoir 2 for mascara liquid and an outer covering 3, both of which consist of plastic. The outer covering 3 is lucent. The reservoir 2 may be, but is not necessarily, lucent.

A neck 2' having a tapered diameter and a male thread 4, on which the female thread 5 of the cap 6 is screwed, is formed at the top of the reservoir 2.

A stripping device 7 is inserted in the neck 2', which overlaps the front end 8 of the neck 2' with a collar 9 serving as a sealing.

A stem 12' is inserted in the cap 6 by way of an annular bead 10 on the inner side of the cap 6 and a corresponding groove 22 of an applicator carrier 12, at the free lower end of which stem 12' an applicator 13 is disposed which is stripped off by means of the stripping device 7 when the cap 6 is unscrewed and the applicator 13 is pulled out.

Figure 2:
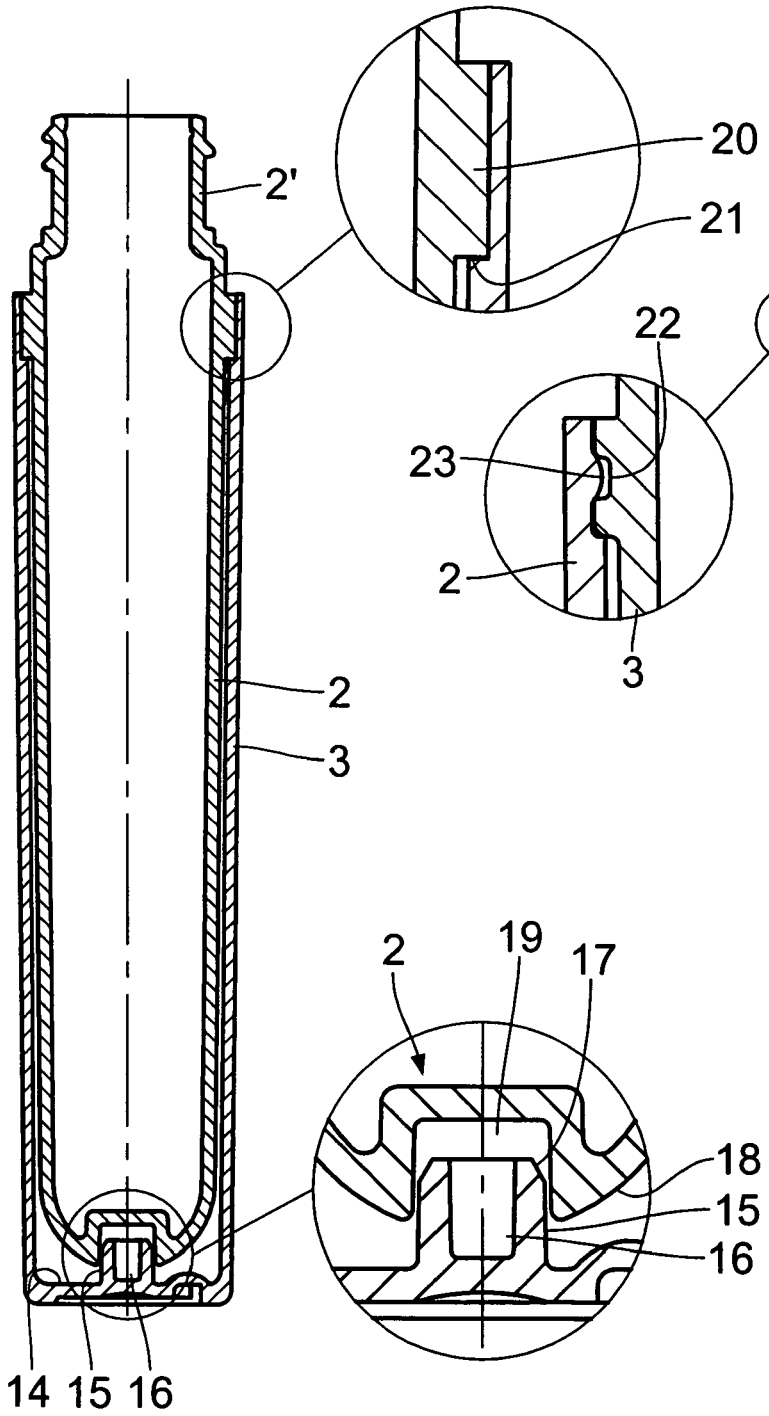
FIG. 2 is a longitudinal section of a reservoir and covering with enlarged connection areas.

From FIG. 2 it can be seen that a spigot 15 is disposed in one piece with the bottom 14 of the reservoir 2, which spigot 15 has an upwardly open cavity 16 enabling a flexible yielding in connection with not shown slots. The upper end 17 of the spigot 15 is conical.

A recess 19 is disposed in one piece with the bottom 18 of the reservoir 2, the inner diameter of which corresponds to the outer diameter of the spigot 15 and has a slight undersize compared to the spigot 15, respectively.

Two opposite, axially extending and laterally protruding annexes 20 are provided at the top of the reservoir 2, which engage with corresponding slot-formed recesses 21 on the inner side of the covering 3 and thus provide for a safeguard against rotation between covering 3 and reservoir 2.

Figure 3:
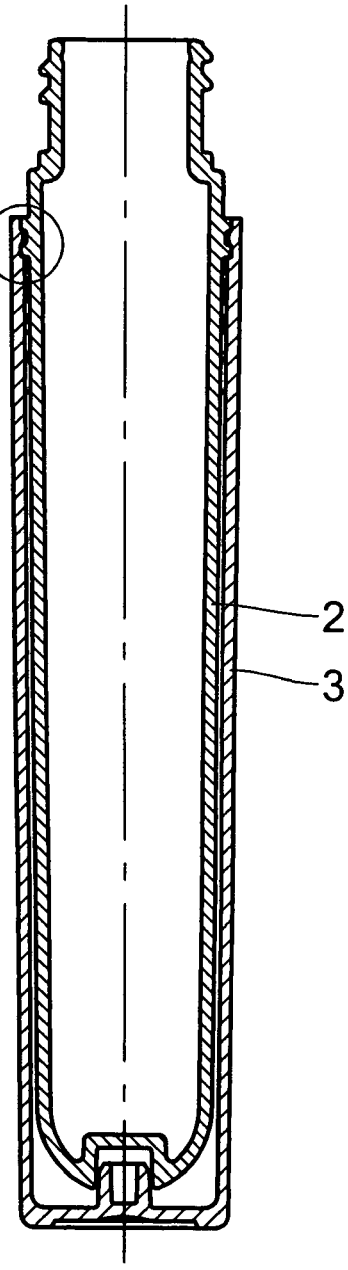
FIG. 3 is a longitudinal section corresponding to FIG. 2, rotated by 90°, with a likewise enlarged connection area.

From FIG. 3 it can be seen that likewise in the area below the neck 2' the reservoir 2 has a groove and cavity 22, respectively, with which a protrusion 23 of the reservoir 2 engages and thus enables axial connection and fixing.

During manufacture, the reservoir 2 and covering 3 are produced independently from one another. Subsequently, the reservoir 2 is inserted in the covering 3 from above in an axial direction until the centering device in the form of the spigot 15 engages with the recess 19 so that a centering of the reservoir 2 in relation to the covering 3 is given, wherein simultaneously lateral protrusions 20 engage with the slot-formed recesses 21 making the connection non-rotary, and wherein furthermore the protrusions 23 engage with the recesses 22 thus enabling an axial fixing.

What is claimed is:

1. An effect packaging for a cosmetic, in particular a mascara unit, comprising:

a lucent reservoir (2) for the cosmetic; and a lucent outer covering (3) surrounding the reservoir (2) , wherein the reservoir (2) and the outer covering (3) are at least partially spaced from one another, wherein a centering device interacting with a bottom (18) of the reservoir (2) is provided at a bottom (14) of the outer covering (3), the centering device is formed by a spigot (15) on an inner side of the bottom (14) of the outer covering (3) and engages with a corresponding recess (19) at the bottom (18) of the reservoir (2), wherein the reservoir (2) and the outer covering (3) are engageable with one another by cooperation between a locking groove (22) at a top of the outer covering (3) and a locking bead (23) at a top of the reservoir (2) by an axial relative movement, so that by joining by the axial movement an automatic centering is provided for, and an air gap with a precisely defined distance of at least 0.1 mm is provided for and maintained between the reservoir (2) and the outer covering (3) so that an inner wall of the outer covering does not rest against the outer wall of the reservoir, wherein two opposite, axially extending and laterally protruding annexes (20) are provided at the top of the reservoir (2), which engage with corresponding slot-formed recesses (21) on the inner side of the covering (3) and prevent rotation between the covering (3) and reservoir (2), whereas likewise in the area below the neck (2') at the top of the reservoir (2) the reservoir (2) has a groove and cavity respectively, with which a protrusion (23) of the reservoir (2) engages and enables axial connection and fixing.

2. An effect packaging according to claim 1, wherein the spigot (15) has a cavity (16) and longitudinal slots.

3. An effect packaging according to claim 1, wherein a top of the spigot (15) is conically tapered.

4. An effect packaging according to claim 1, wherein the outer covering (3) is formed in one piece.

5. An effect packaging according to claim 1, wherein the outer covering (3) is made of glass.

6. An effect packaging according to claim 1, wherein a wall thickness of the outer covering (3) is between 0.3 and 10 mm.

7. An effect packaging according to claim 1, wherein the reservoir (2) is lucent and stained.

8. An effect packaging according to claim 1, wherein the reservoir (2) is lucent and printed, stamped (HF stamping) or metallized.

9. An effect packaging according to claim 1, wherein the outer covering (3) is at least partially metallized.

10. An effect packaging according to claim 1, wherein the spigot (15) protrudes out from an inner side of the bottom (14) of the outer covering (3).

* * * * *